United States Patent [19]

Pirkey

[11] Patent Number: 4,919,980

[45] Date of Patent: Apr. 24, 1990

[54] DECORATIVE ORNAMENT AND METHOD OF MAKING SAME

[76] Inventor: Arla Pirkey, 105 Bond St., Travis Air Force Base, Calif. 94535-1514

[21] Appl. No.: 245,678

[22] Filed: Sep. 19, 1988

[51] Int. Cl.[5] ..... D04D 7/10

[52] U.S. Cl. ..... 428/4; 28/147; 223/46

[58] Field of Search ..... 28/147; 223/46; 428/4,5,15

[56] References Cited

U.S. PATENT DOCUMENTS 2,257,154 9/1941 Bleyer ..... 428/4

2,587,502 2/1952 McMahon ..... 428/5

3,030,719 4/1962 Enomoto ..... 428/5 X 3,283,339 11/1966 Heifetz ..... 428/4 X 4,095,031 6/1978 Engle ..... 428/24 X

*Primary Examiner*—Henry F. Epstein

*Attorney, Agent, or Firm*—Richard C. Litman

[57] ABSTRACT

A decorative ornament and the method of making the decorative ornament are disclosed. The ornament is made by twisting and coiling a loop of sheet material. Next, the coiled loop of sheet material is stapled at its center to a backing sheet. The ends of the loops are cut and trimmed, forming a number of radially extending leaves in a hemispherical shape.

7 Claims, 2 Drawing Sheets

DECORATIVE ORNAMENT AND METHOD OF MAKING SAME

FIELD OF THE INVENTION

The invention relates to a decorative ornament, and more particularly, the invention is directed to an improved bow decoration constructed from a loop of sheet material.

The invention further relates to a method of making a decorative ornament from a continuous loop of sheet material. More particularly, the invention is directed to providing a method of twisting and cutting a loop of material to create a hemispherical bow.

By the present invention, a bow-shaped decorative ornament is provided which is attractive and simple to manufacture, and the decorative ornament, and the method of construction of the decorative ornament are more fully described herein.

1. Background of the Invention

Many types of bows and decorative ornaments are in use. However, the present invention provides a decorative ornament, and the method of its construction, from a single loop of sheet material. Thus, the present invention provides an attractive and easily constructed bow. The method of construction of the bow is readily achievable by hand, using a minimum of components. More particularly, the invention is especially suited to be constructed using a resilient plastic sheet material.

2. Description of the Prior Art

Various prior art bows, decorative ornaments and the like, as well as their apparatuses and the method of their construction in general, are known and found to be exemplary of the U.S. prior art. U.S. Pat. No. 2,257,154 to G. S. Bleyer discloses a spherical ornament in which the body of the ornament is composed of sheet material in strip form which is puckered or gathered by a wire or tie at the center of the bow. U.S. Pat. No. 2,587,502 to T. L. McMahon teaches a prefabricated piece of ribbon for conversion into a pompon bow. U.S. Pat. No. 3,030,719 to T. Enomoto discloses a strip of ribbon material which can be formed into a flower shaped bow.

These patents or known prior uses teach and disclose various types of bows and decorative ornaments and the like, as well as methods of their construction; but none of them, whether taken singly or in combination, disclose the specific details of the combination of the invention in such a way as to bear upon the claims of the present invention.

SUMMARY OF THE INVENTION

An object, advantage, and feature of the invention is to provide a novel decorative ornament that is constructed from a loop of sheet material. The decorative ornament is in the shape of a bow, and has radially extending folds.

Another object, advantage, and feature of the invention is to provide a novel decorative ornament in the shape of a hemispherical bow which is crush resistant.

Another object of the invention is to provide a decorative ornament which may have a scented backing.

Yet another object of the invention is to provide a novel and improved method of making a decorative ornament, whereby an elongated loop of sheet material is twisted about itself, affixed to a backing sheet, and cut to form a decoration of the character described.

Still another object of the invention is to provide a novel and improved method of making a decorative ornament, whereby an elongated loop of plastic sheet material is used to provide a resilient construction.

These, together with other objects and advantages of the invention reside in the details of the process and the operation thereof, as is more fully hereinafter described and claimed. References are made to drawings forming a part hereof, wherein like numerals refer to like parts throughout.

A BRIEF DESCRIPTION OF THE DRAWINGS

A DETAILED DESCRIPTION OF THE PREFERRED EMBODIMENT OF THE INVENTION

Figure 1:
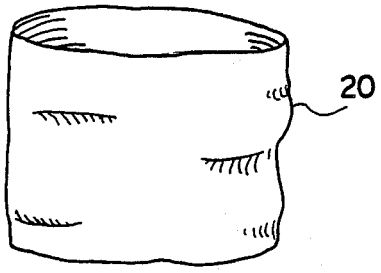
FIG. 1 is a perspective view of a loop of sheet material.

Referring now to the drawings, in which like numerals refer to like parts throughout, there is shown a decorative ornament and the method of making the ornament. FIG. 1 shows an elongated loop 20 of continuous sheet material. Any sheet material may be used, although a resilient material is preferred. In the preferred embodiment, the sheet material may be low density polyethylene film. A thickness of 0.005 inches is preferred. The sheet material may be opaque or translucent, in any suitable color.

Figure 2:
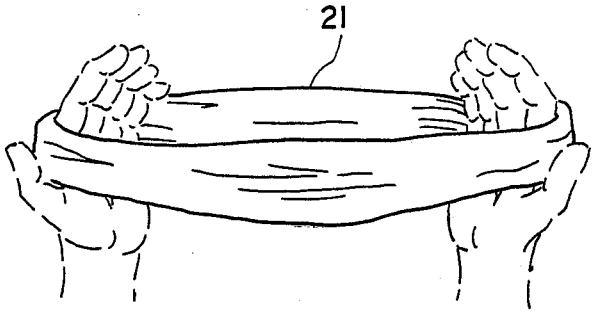
FIG. 2 shows the loop of sheet material being collapsed laterally to form a narrow continuous loop.
Figure 3:
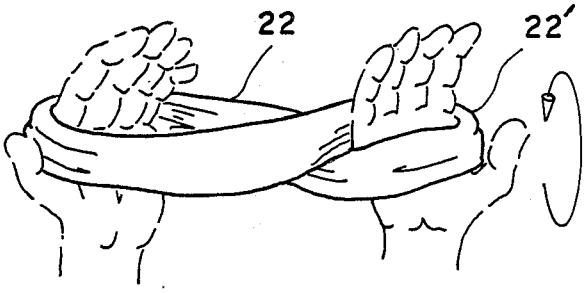
FIG. 3 shows the narrow continuous loop being twisted into two loops.

FIG. 2 shows the loop of FIG. 1 being collapsed laterally into a narrow continuous loop 21. FIG. 3 shows the narrow continuous loop of FIG. 2 being twisted into two loops 22 and 22'. The two loops 22 and 22' are then coiled concentrically as shown in FIG. 4.

Figure 4:
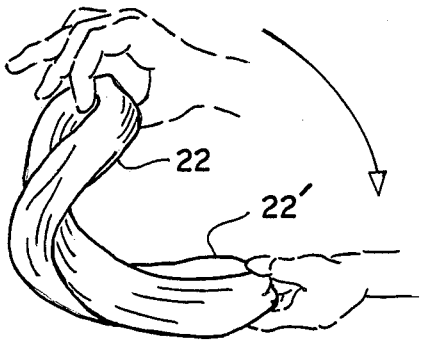
FIG. 4 shows the two loops being coiled concentrically.
Figure 5:
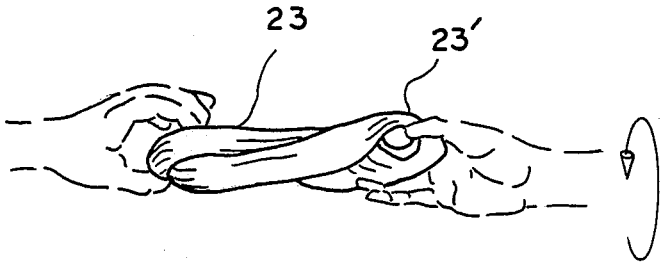
FIG. 5 shows the coiled loops of FIG. 4 being twisted into two loops.
Figure 6:
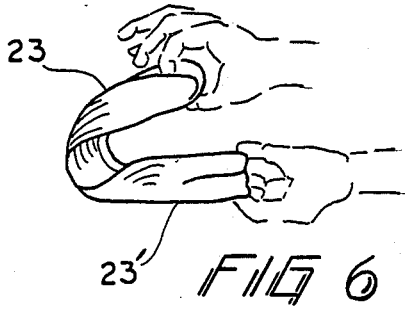
FIG. 6 shows the two loops of FIG. 5 being coiled concentrically.

FIG. 5 shows the two coiled concentric loops of FIG. 4 being twisted into two pairs of loops 23 and 23'. The two pairs of loops 23 and 23' are then coiled concentrically as shown in FIG. 6.

Note that the twisting and coiling steps illustrated in FIGS. 3 to 6 may be repeated in any suitable number of iterations, depending on the size of the sheet 20 and the size of the final bow desired.

Figure 7:
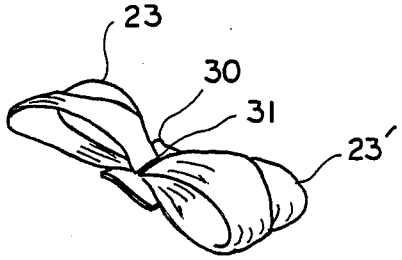
FIG. 7 shows the loops of FIG. 6 being stapled at the middle to a backing piece.
Figure 8:
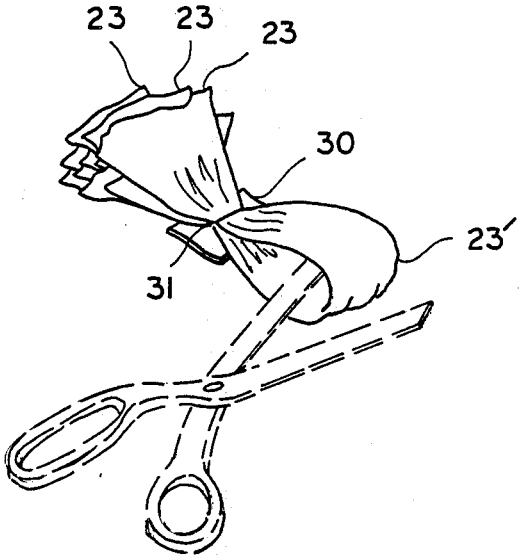
FIG. 8 shows the loops being cut at their far ends.
Figure 9:
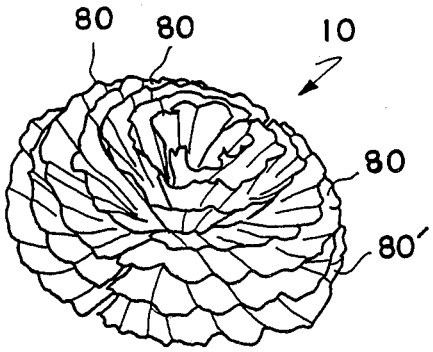
FIG. 9 shows the decorative ornament of the present invention, according to a preferred method and the best mode of the present invention.

FIG. 7 shows the two pairs of loops 23 and 23' being tied in the middle to a backing sheet 30 by staple 31. The backing sheet 30 may have an adhesive side for attaching the completed bow to another surface. In addition the backing sheet 30 may be scented of so desired. FIG. 8 shows the loops 23 and 23' being cut at their ends by a scissors or other similar tool. The foregoing process results in a bow which is roughly hemispherical in shape. The ends of the leaves of the bow may be fluffed to give a more even texture and then trimmed to provide a more smooth surface. FIG. 9 shows the finished bow 10, having a plurality of leaves 80. The leaves 80 extend radially from the backing 30, and are tied to the backing 30 by a staple or tying member 31. The shape of the leaves 80 helps the bow to resist crushing. Further, the use of a resilient sheet material provides for the bow to return to its original shape if crushed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. A method of making a decorative ornament from an elongated continuous loop of sheet material, comprising;

(a) collapsing said elongated continuous loop of sheet material laterally to form a narrow continuous loop;

(b) imparting a 180 degree twist and coiling at least once said narrow continuous loop to form a plurality of coiled concentric loops;

(c) twisting said coiled concentric loops about a central point;

(d) affixing a tying member to affix said central point of said coiled concentric loops to a backing sheet; and (e) cutting the distal ends of said coiled concentric loops to form a plurality of radially extending folds.

2. The method of making a decorative ornament of claim 1, further including;

(f) trimming said radially extending folds to into a desired shape; and (g) fluffing said radially extending folds to evenly space said radially extending folds.

3. A method of making a decorative ornament according to claim 1 wherein;

said sheet material is formed from polyethylene film.

4. A method of making a decorative ornament according to claim 1, wherein;

said sheet material is between 0.001 and 0.010 inches in thickness.

5. A method of making a decorative ornament according to claim 1, wherein;

said sheet material is 0.005 inches in thickness.

6. A method of making a decorative ornament according to claim 1, wherein;

said sheet material is colored.

7. A decorative ornament, comprising;

an article manufactured according to the process of claim 1.

* * * * *